US006443878B1

(12) United States Patent
Webber

(10) Patent No.: US 6,443,878 B1
(45) Date of Patent: Sep. 3, 2002

(54) LEG EXERCISE APPARATUS FOR EXERCISE MACHINE

(76) Inventor: Randall T. Webber, 100 Harbor Dr., #1404, San Diego, CA (US) 92101

( * ) Notice: Subject to any disclaimer, the term of this patent is extended or adjusted under 35 U.S.C. 154(b) by 0 days.

(21) Appl. No.: 09/774,129

(22) Filed: Jan. 30, 2001

(51) Int. Cl.[7] ..... A63B 21/06

(52) U.S. Cl. ..... 482/130; 482/140; 482/142; 482/100; 482/133

(58) Field of Search ..... 482/100, 133, 482/94, 97–99, 101, 134, 137–139, 1, 130

(56) References Cited

U.S. PATENT DOCUMENTS

| | | | | |
|---|---|---|---|---|
| 4,256,302 | A | | 3/1981 | Keiser |
| D263,978 | S | | 4/1982 | Brentham |
| 4,678,185 | A | | 7/1987 | Mahnke |
| 4,746,114 | A | * | 5/1988 | Grider ..... 482/100 |
| D296,709 | S | | 7/1988 | Gvoich et al. |
| 4,858,915 | A | | 8/1989 | Szabo |
| D303,558 | S | | 9/1989 | Alessandri |
| D306,053 | S | | 2/1990 | Beistegui |
| 4,915,377 | A | | 4/1990 | Malnke |
| 4,949,951 | A | | 8/1990 | Deola |
| D330,238 | S | | 10/1992 | Desiderio |
| 5,236,406 | A | | 8/1993 | Webber |
| 5,356,360 | A | * | 10/1994 | John ..... 482/99 |
| 5,395,295 | A | * | 3/1995 | Ish, III ..... 482/100 |
| D358,183 | S | | 5/1995 | Habing et al. |

(List continued on next page.)

OTHER PUBLICATIONS

Astro–fit Brochure, Date unknown.
Body Focus Body Weight Resistance System, Weslo, Inc. 1994.
Body Masters, Masters Trainer 1A, undated.
Product 5453, Cybex Brochure, 1996.
Cybex Leg Curl.
Cybex Personal 200—Date unkown.
Freeform Prolink, Date unknown.
Freeform Ultimate Home Fitness System, undated.
H–100 Multi–Gym, Hoist brochure, 1999.
Hoist B–700 Gym.
Hoist F160 and F162, Hoist Assembly Manuals, 1995.
H–130, Hoist Fitness Brochure, 1999.
225 Home Gym, Parabody brochure, 1997.
Marcy Em/1, undated.
Maxicam, Muscle Dynamics, undated.
Multi–Function Home Gym 880–3D, Hoist Fitness Systems.
New form brochure, undated.
Newport brochure, Jul. 1996 Pacific Fitness.
On–Line 1200, Vectra brochure, 1996.
Pacific Brochure, 1996.
Pacific Finess brochure, 1997.
Pacific Fitness Catalina.
Pacific Fitness, Del Mar. 1999.
Parabody 40, Parabody brochure, 1998.
Schwinn brochure, 1994.
Sears Body Lift Pro–Form Owners Manual, 1994.
Tuff Stuff Muscle 3, date unknown.
Vectra C–1, undated.

*Primary Examiner*—Jerome W. Donnelly
(74) *Attorney, Agent, or Firm*—Brown, Martin, Haller & McClain, LLP

(57) ABSTRACT

An exercise apparatus has a support frame and a seat mounted on the support frame having a forward end. A leg exercise arm has a first end pivoted to the support frame adjacent the forward end of the seat, and a second end. The arm has a continuous curve extending along at least a major portion of its length and bending through an arc of at least 180 degrees. In its rest position, the arm first projects forwards from the pivot and then bends back rearwards. A cable links the arm to an exercise resistance, and a leg engaging assembly is mattached to the arm for engagement by the legs of a user in performing exercises.

18 Claims, 4 Drawing Sheets

U.S. PATENT DOCUMENTS

| | | | | |
|---|---|---|---|---|
| D359,326 | S | | 6/1995 | Deola |
| D370,040 | S | | 5/1996 | Habing et al. |
| D370,950 | S | | 6/1996 | Webber |
| 5,653,669 | A | | 8/1997 | Cheng |
| 5,674,167 | A | | 10/1997 | Piaget et al. |
| 5,733,229 | A | | 3/1998 | Dalebout |
| 5,961,428 | A | | 10/1999 | Webber |
| 6,090,020 | A | * | 7/2000 | Webber ..... 482/100 |

* cited by examiner

LEG EXERCISE APPARATUS FOR EXERCISE MACHINE

BACKGROUND OF THE INVENTION

The present invention relates generally to weight lifting exercise machines, and is particularly concerned with a leg exercise apparatus for such machines.

Weight lifting machines normally have a leg extension/leg curl arm pivoted at the front end of the machine adjacent the seat and linked to the exercise resistance to permit a user to perform leg exercises. Such devices are described, for example, in U.S. Pat. Nos. 4,678,185 and 4,915,377 of Mahnke. The exercise arm in these machines is straight. In some prior art leg exercise arms, a pulley is mounted on the straight arm, for example the 880-3D Howe Gym of Hoist Fitness Systems has a pulley at the end of the straight exercise arm. The problem with straight leg exercise arms is that the exerciser will experience a drop off or reduction in resistance while performing an exercise. This is because the exercise arm goes through an arcing motion, and the cable attached to the arm is therefore not pulled at a constant rate. The first half of the movement pulls more cable than the second half, causing a drop off in resistance. In order to prevent the drop off in resistance, some manufacturers have attached a cam or curved piece of metal to the end of the exercise arm, providing a surface for the cable to wrap around during the second half of an exercise movement, so that the cable is pulled at an even rate during the entire movement. However, this adds to the expense of the machine and also causes design restrictions due to the rearward protrusion of the cam.

Another disadvantage to the straight exercise arm is that it usually requires a stop mechanism to prevent movement in a rearward direction when tension is applied to the cabling via another exercise station.

The straight leg exercise arm also has a third disadvantage when a pulley is mounted at the end of the arm for performing other exercises such as upper body, standing position exercises. The user stands facing the machine and pulls the cable upward using various handle attachments. In order to perform such exercises, the exerciser must stand back from the machine to avoid damaging the cable by rubbing it against the front of the machine. This requires additional floor space. It can also be difficult to access the cable attachment point if the pulley is located at the end of the straight arm.

A further disadvantage to the straight exercise arm is its inability to provide a grip area and act as a handle for moving the exercise machine. With floor space becoming more and more of an issue in homes and health clubs, the ability to add wheels and easily maneuver equipment around is of increasing importance. It is common place for manufacturers to install wheels on their exercise equipment. These wheels are usually placed on the rear of the equipment with some sort of handle or gripping area on the opposite end. The user then bends down, grabs the handle, lifting the front end and tilting the equipment back on its wheels, where it is ready for moving. The larger/heavier the piece, the harder it is to lift and the higher the handle needs to be placed to avoid causing back strain to the lifter. Because this is difficult to achieve, most pieces with leg extension arms (particularly multi-function home gyms) do not have wheels for moving.

U.S. Pat. No. 5,393,295 of Ish describes a leg extension arm which projects forwards from the frame and has a separate rearwardly protruding cam which must be welded to the arm, making the construction relatively expensive. The arm hangs in a substantially vertical orientation. The machine is not equipped with wheels and is too large for moving safely. The leg engaging rollers are pivotally connected to the arm to accommodate various leg lengths and do not maintain a constant relationship to the cable attachment point. This will cause slight variations in resistance based on the leg roller position.

Some known exercise machines, such as the Muscle 3 machine of Tuff Stuff, have exercise arms which are straight along part of their length but which have a rearward curve in their lower portions. These generally rest in a substantially vertical orientation, and have sharp end edges around which the cable must bend at the finish of a standing leg curl exercise, which could damage the cable.

U.S. Pat. No. 5,961,428 of Webber shows an exercise machine with a forwardly curved exercise arm which has a slight bend in its lower portion, but which rests in a substantially vertical orientation and does not provide any comfortable or safe gripping area for lifting or moving the machine. The machine is not equipped with wheels for moving. A pulley mounted at the second end of the arm allows the cable end to be used in performing additional exercises.

SUMMARY OF THE INVENTION

It is an object of the present invention to provide a new and improved leg exercise arm apparatus for an exercise machine.

According to the present invention, an apparatus for performing exercises is provided, which comprises a support frame, a seat mounted on the support frame and having a forward end, an exercise arm having a first end pivoted to the support frame adjacent the forward end of the seat, and a second end, the arm having a continuous curve extending along at least a major portion of its length and bending through an arc of at least 180 degrees, the arm having a rest position in which the arm first projects forwards from the pivot and then bends back rearwards, a cable linking the arm to an exercise resistance, and a leg engaging assembly attached to the arm for engagement by the legs of a user in performing exercises.

The continuous, 180 degree rearward curve of the arm acts as a cam and provides a surface for the cable to wrap around during the exercise movement. This keeps a constant pull on the cable and helps prevent resistance drop off. In an exemplary embodiment, the second end of the arm rests against an undersurface of the seat support frame when the arm is in a rest position and acts as a stop against rearward movement of the arm when in the rest position.

The second end of the arm may be of rounded, non-sharp shape to provide a smooth, curved surface for the cable to wrap around when performing certain exercises. In one exemplary embodiment, a tubular member is mounted at the second end of the arm in an orientation transverse to the arm axis, and acts as the rearward stop. The tubular member also provides the round surface for the cable to wrap around, instead of a sharp edge at the end of an arm. The round surface at the end of the arm helps to prevent resistance drop off at the very end of an exercise movement, and prolongs cable life. This is because the cable is not bent over a sharp edge on the end of an exercise arm, as was common in prior art exercise arms. Constant bending over a sharp edge will cause the inner wire strands of a cable to fatigue and eventually break, causing premature failure of the cable.

This invention does not require a separate cam to be welded onto the exercise arm, but instead integrates the cam into the shape of the exercise arm itself. This makes the exercise arm easier and cheaper to manufacture, since it avoids the elaborate secondary welding typically required in past designs.

The upper end of the arm projects forwards before curving rearwards, providing a comfortable, easy to reach gripping area which is free of pinch points. The forward angle of the arm places the user's wrist in a comfortable and natural position for lifting. Thus, the arm can be used as a handle for lifting or tilting the machine for moving. The gripping area is adjacent the pivot point of the exercise arm on the frame. This makes the arm less likely just to pivot when gripped and pulled upwardly, and more readily usable as a handle in lifting the machine. In an exemplary embodiment, wheels are provided at the rear end of the frame for engaging the floor when the forward end is tilted upwardly, allowing the machine to be re-positioned readily. A locking or pinning device may be provided for releasably securing the arm in position during use of the arm as a handle for lifting the forward end of the machine when moving the machine.

The leg engaging device in an exemplary embodiment comprises a pair of oppositely directed, leg engaging rollers which are positioned at the lowest point of the curved arm portion, adjacent and below the cable attachment point. This means that the resistance to the arm as felt by the user is more or less a true 100% of the amount selected. The further the cable contact point is from the leg engaging rollers, the greater the deviation in resistance felt by the user from the selected weight. With this invention, because the entire arm acts as a cam, the leg engaging rollers can be placed adjacent the cable contact or attachment point.

The leg exercise arm initially projects forwardly, yet still utilizes the second end as a stop against rearward movement. This spaces the stop away from the pivot point, eliminating rearward flex which may occur when the stop is close to the pivot. The closer a stop is to the pivot point of the arm, the greater the force it will receive when the cable is tensioned by performing an additional exercise. This arrangement avoids or reduces this problem.

The continuous, 180 degree curve of the exercise arm provides many advantages. It provides a built-in cam to keep a constant resistance throughout the exercise motion, combined with a part of the arm still projecting forward of the exercise frame pivot. The arrangement also permits the second end of the arm to act as a stop against rearward motion. The leg engaging rollers can be positioned on the curve of the arm, adjacent the lowest point of the arm and the cable contact point, to provide true, 100% exercise resistance based on the selected weight.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
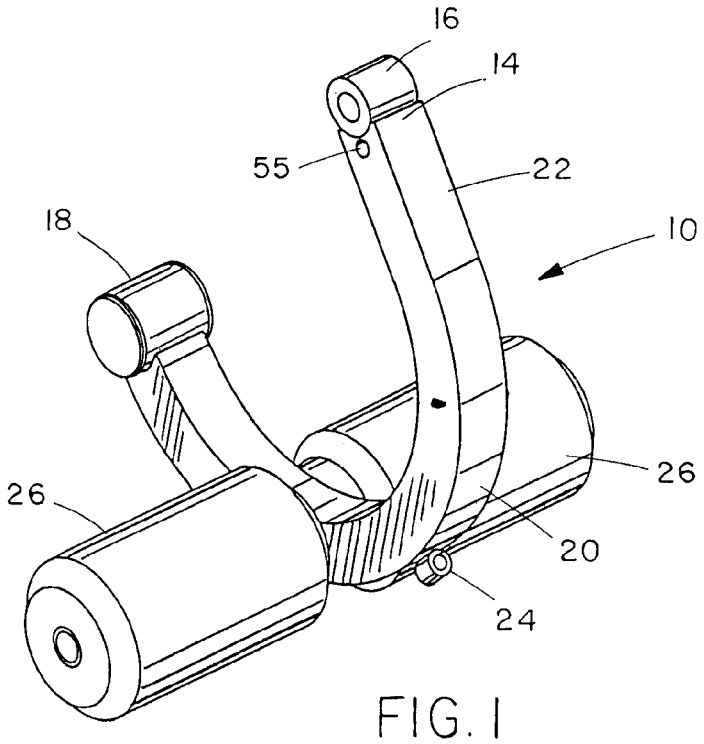
FIG. 1 is a perspective view of a leg exercise arm according to a first embodiment of the invention.

FIG. 1 illustrates a leg exercise arm 10 according to an exemplary embodiment of the invention, while FIGS. 2 to 6 illustrate the arm 10 mounted on an exercise machine 12. The arm 10 has a first end 14 on which a pivot sleeve 16 is transversely mounted, and a second end on which a tube or cylinder 18 is mounted perpendicular to the tube axis. The arm itself has a continuous, 180 degree curve 20 extending along the majority of its length, with just a short portion 22 adjacent the first end 14 being straight. The arm is of generally square or rectangular rod or tubing, providing a smoothly curving flat guide surface, as indicated in FIG. 1. However arm 10 may be of other cross-sectional shapes, such as round, in alternative embodiments. A cable anchor or attachment bracket 24 is secured to an outer surface of the arm at a location spaced between the two ends, and a pair of leg engaging rollers 26 project from opposite sides of the arm at a short spacing below the cable anchor 24.

The leg exercise arm 10 may be mounted at the forward end of the seat portion of any weight lifting or resistance exercise machine. The exercise machine 12 of FIGS. 2 to 6 has a support frame having a first, generally upright strut 28 which is inclined forwards from the top 30 of the frame towards the base, and has a forwardly-directed, generally horizontal base portion or foot 32 for engaging the ground. A second strut 34 extends from an intermediate position on the first strut 28 to the rear of the machine, and is inclined downwardly to engage the floor at a horizontal base portion or foot 35 which has a wheel or roller 36 at its free end. A pair of vertical guide rods 37 extend from foot 34 upwardly to the top 30 of the frame. A weight stack (not illustrated) may be slidably mounted on the guide rods 37. A third, seat supporting strut 38 projects horizontally from the first strut 28 to the forward end of the frame. A seat pad 40 is mounted on top of strut 38, while a back pad 42 is adjustably mounted on the upright, inclined strut 28.

Figure 2:
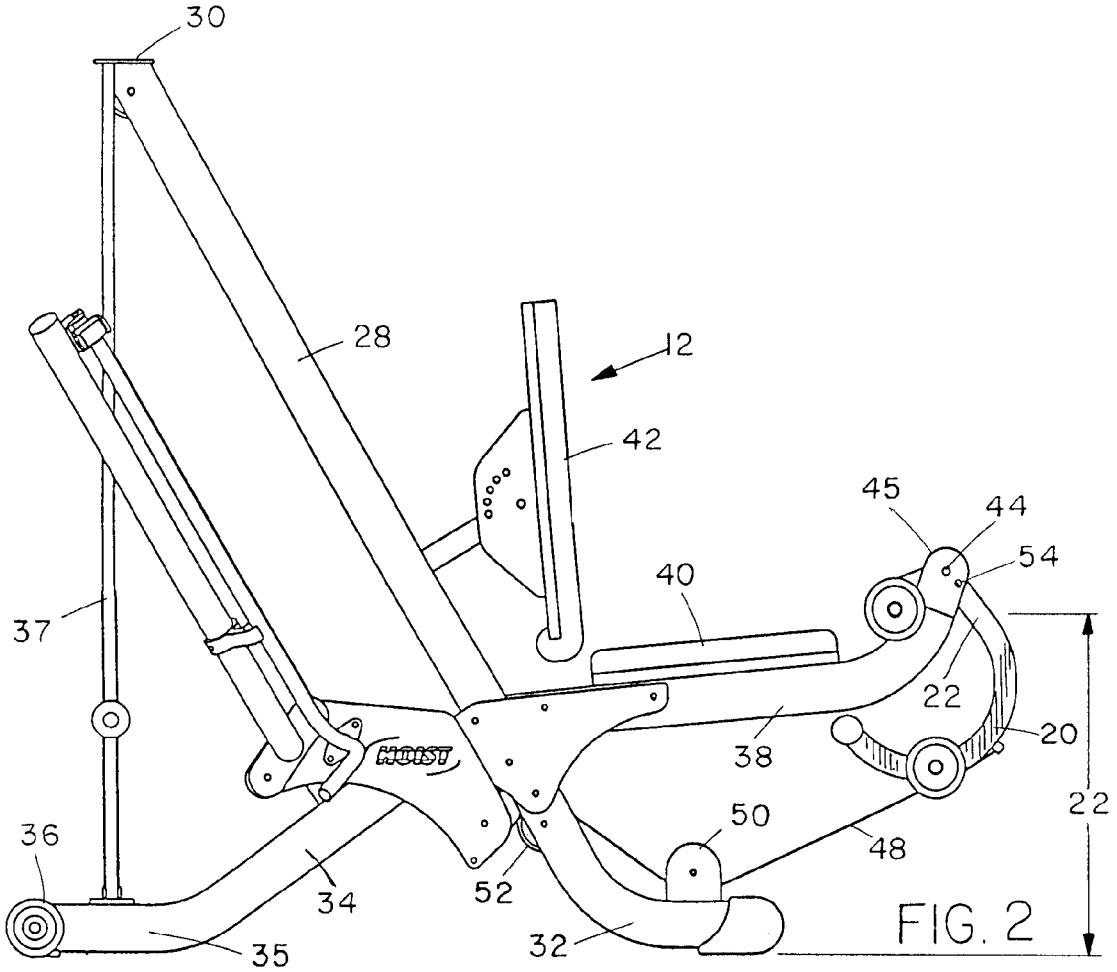
FIG. 2 is a side elevational view illustrating the arm of FIG. 1 mounted on an exercise machine.
Figure 4:
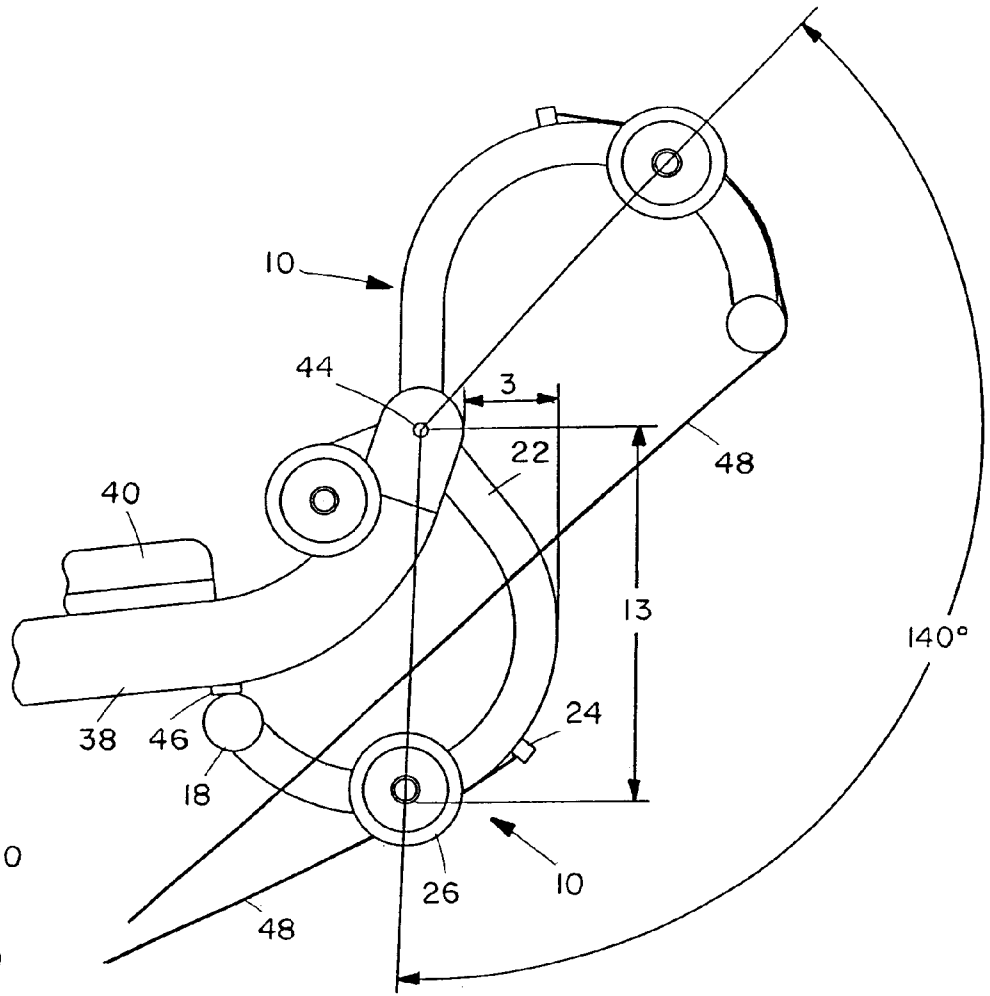
FIG. 4 is an enlarged view of the arm pivotally mounted on the frame of the exercise machine, illustrating the range of movement of the arm about the pivot axis.

As best illustrated in FIGS. 2 and 4, the first end 14 of the exercise arm is pivotally mounted at the forward end of the seat supporting strut 38. A pivot pin 44 extends between a pair of mounting brackets 45 at the end of strut 38 and through pivot sleeve 16. The arm is suspended downwards from the pivot mount, and the lower part of FIG. 4 illustrates the rest orientation of the arm when not in use. In this orientation, the upper portion of the arm first projects forwards from the forward end of the strut 38, and then curves downwards and rearwards. The tube 18 at the second end acts as a stop, engaging a suitable stop pad 46 on the lower surface of strut 38 adjacent the forward end of seat pad 40 in the rest position illustrated in FIG. 4. A cable 48 extends from attachment point or anchor 24 on the arm along a guide path extending around a first pulley 50 on foot 32 and a second pulley 52 on strut 28. Cable 48 is suitably linked to a weight stack or other suitable exercise resistance in a conventional manner.

Figure 3:
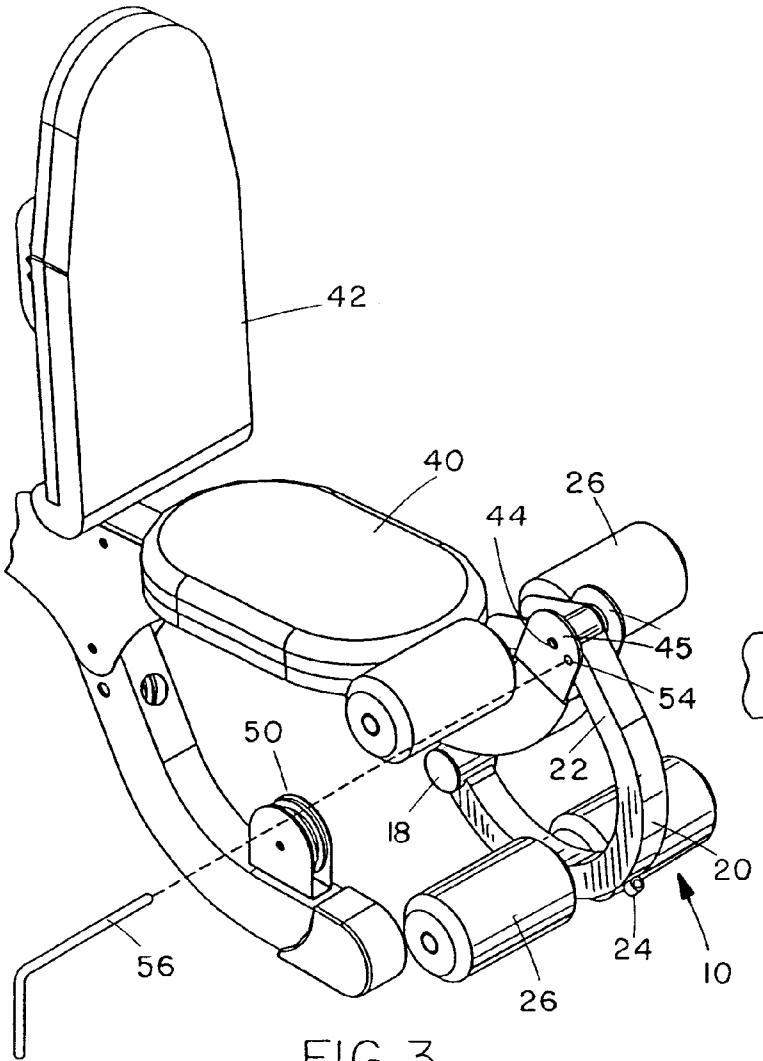
FIG. 3 is a front perspective view of part of the machine of FIG. 2.

At least one of the mounting brackets 45 has a hole 54 for alignment with a corresponding hole 55 in the exercise arm in the rest position of FIGS. 3 and 4. Alternatively, both brackets 45 may have aligned holes 54. A lock pin 56 may be engaged through the aligned pinning holes 54 and 55 in order to prevent the arm from pivoting about its pivot axis, as indicated in FIG. 3. This will permit the upper portion of the arm to be more readily used as a handle, as explained in more detail below. Other types of locking or pinning systems may be used instead of lock pin 56.

The continuous curving shape of the exercise arm 10 ensures that the cable 48 will not contact the machine at any point in an exercise movement. In order to perform some leg exercises, a user seated on seat pad 40 will engage the leg rollers 26, which are suitably padded rollers of cushioning material such as foam, and will push forwards away from the rest position of FIGS. 2 and 3. As the arm is rotated forwards, the cable will wrap around the smoothly curved outer surface of the arm, and will eventually wrap around the cylindrical roller or tube 18 at the second end of the arm, as indicated in FIG. 4, when certain exercises are performed, such as a standing leg curl. As indicated in FIG. 4, the arm will rotate through an angle of around 140 degrees from the lower, rest position to the upper position when performing a standing leg curl. The roller or tube 18 provides a smoothly curved surface around which the cable can wrap, avoiding bending of the cable around sharp edges which may cause damage or cable failure. It will be understood that the roller or tube may be replaced with any other suitably rounded or curved surface in alternative embodiments.

The leg engaging rollers 26 are positioned on the curved portion of the arm 10 below the cable attachment point and at the lowest point of the arm when in the rest position, as indicated in FIG. 2. This puts the rollers immediately adjacent the point where the cable contacts the outer surface of the arm, helping to ensure that the resistance on the arm is a true 100% of the weight selected.

Figure 5:
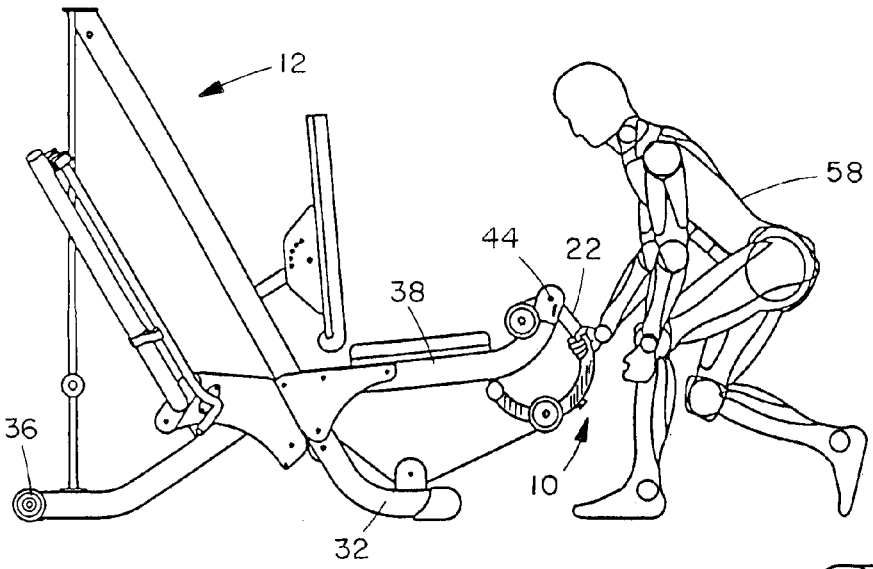
FIG. 5 is a side elevational view of the machine illustrating a user gripping the arm to use the arm as a handle when lifting the front end of the machine.
Figure 6:
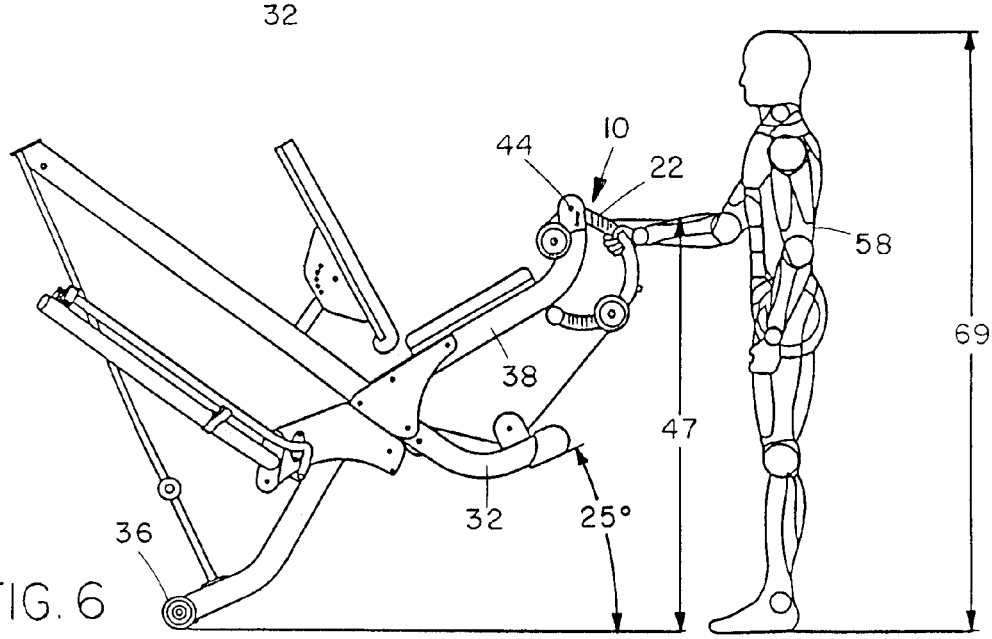
FIG. 6 is a side elevational view similar to FIG. 5 illustrating the user supporting the front end of the machine using the arm as a handle, prior to pushing or pulling the machine to a new position.

Another advantage of the 180 degree, rearwardly curved arm which initially inclines forwards from the front end of the machine is that it places the upper part of the arm out in front of the main frame, providing a comfortable, easy to reach gripping area which is free of pinch points. Thus, the forwardly projecting upper part of the arm can readily be used as a handle when moving or positioning the machine, as generally indicated in FIGS. 5 and 6. As indicated in FIG. 3, the arm 10 in the rest position first projects forwardly from the machine by a distance of around three inches. The straight, upper portion 22 of the arm in the rest position is located at a distance of approximately 22 inches from the ground, as indicated in FIG. 2.

When a user wishes to lift the forward end of the machine in order to move the machine on roller or wheel 36, they first bend forward and grip the straight portion 22, as indicated in FIG. 5. If desired, they may first lock the arm in position using lock pin 56, although this is not essential due to the closeness of the handle portion to the pivot 44. FIG. 5 illustrates the starting position of a user of average height (5'9") using the handle portion 22 to lift the front end of the machine. The user then stands upright, simultaneously lifting the front end of the machine upwardly, into the finish position of FIG. 6. FIG. 6 shows the finish position, in inches and degrees, of the machine when lifted. At this point, the machine rests on the rear wheel 36 and can be readily moved by the user 58, using the arm portion 22 as a handle. Because of the exercise arm design which provides a forwardly inclined handle portion at a convenient height for gripping by the user, in front of the machine, it has been found that it only requires about twenty pounds of counter-balance resistance to the arm to use it effectively as a handle.

Figure 7:
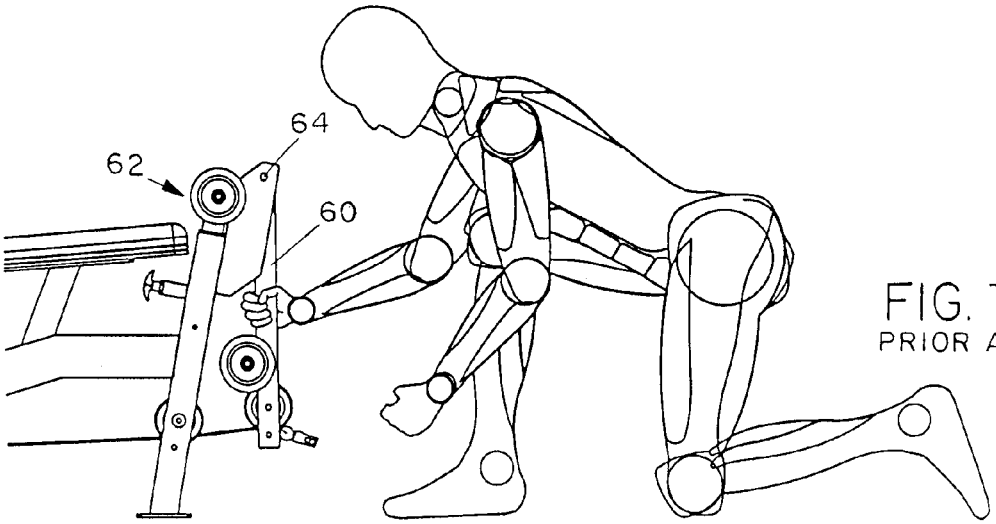
FIG. 7 PRIOR ART
FIG. 7 is a side elevational view of a prior art, straight exercise arm and a user attempting to use the arm in lifting a machine.

FIG. 7 illustrates the starting position of a user of equivalent height if attempting to use a conventional, straight leg exercise arm 60 as a handle for lifting the front end 62 of an exercise machine. The exercise arm 60 extends vertically downwards from the pivot 64, and must be gripped at a much lower height than the portion 22 of the arm of FIG. 5. In fact, this position is about five inches lower than the gripping position of FIG. 5, and is farther from the pivot point 64. The user will therefore have to kneel in order to try and lift the machine safely, avoiding potential back injury. In this position, it would require considerable strength for the user to stand up with the machine. Additionally, the direction of lift for moving the machine is different in this case. With the exercise arm of this invention, as illustrated in FIGS. 5 and 6, the user can rotate the arm through an arc in order to lift the machine upwardly. In contrast, with the straight leg exercise arm of FIG. 7, the arm must be lifted straight up, which is awkward and requires greater grip strength to keep the hand from slipping. If the arm is pulled forward towards the user, it will rotate about its pivot point and cannot be used to lift or tilt the machine for moving. In contrast, the arm of this invention can be rotated through an arc in a comfortable and natural manner in order to lift the machine from the position of FIG. 5 to that of FIG. 6.

It can be seen that the rest position of the leg exercise arm of this embodiment, as best illustrated in FIGS. 2 and 5, places a handle or gripping portion 22 of the arm out in front of the machine, in a comfortable, easy to reach area, free of pinch points. The forward angle of portion 22 of the arm places the user's wrist in a comfortable and natural position for lifting, as indicated in FIG. 5, as compared to the vertical arm of FIG. 7, which requires the user to grip and lift the arm in a relatively awkward position.

Figure 8:
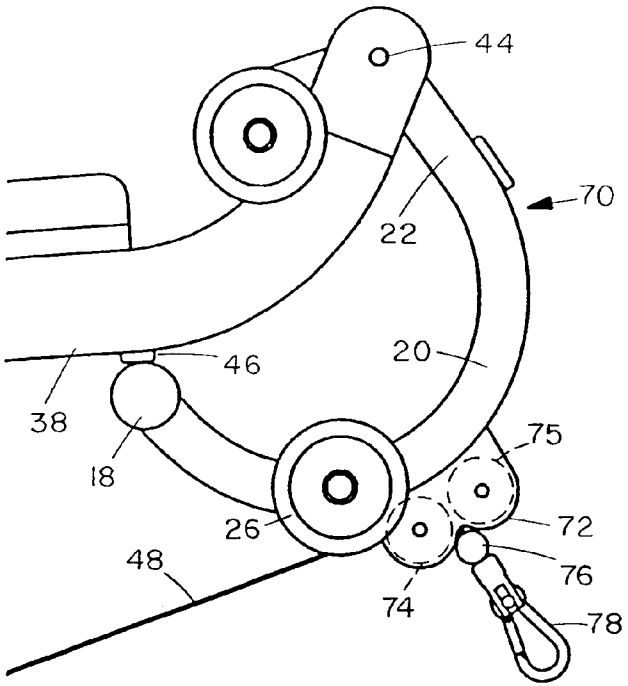
FIG. 8 is a side elevational view of a modified leg exercise arm apparatus according to another embodiment of the invention.

FIG. 8 illustrates a modified leg exercise arm 70 according to another embodiment of the invention. The arm and pivot mount of FIG. 8 are similar to that of the previous embodiment, and like reference numerals have been used for like parts as appropriate. However, the cable anchor or fastener sleeve 24 of FIGS. 1 to 6 is replaced with a pulley housing 72 in which a pair of pulleys 74,75 are rotatably mounted. The cable 48 extends around one of the pulleys 74 and is guided outwardly between the two pulleys. A ball stop 76 and a fastener clip 78 are secured to the free end of the cable. This allows a handle device to be attached to the end of the cable 48, so that it can be used for performing additional exercises in a standing position. The illustrated arrangement uses two pulleys to keep the cable end close to the front of the arm 70 for easy access. However, one pulley could alternatively be used if placed in a different location.

Figure 9:
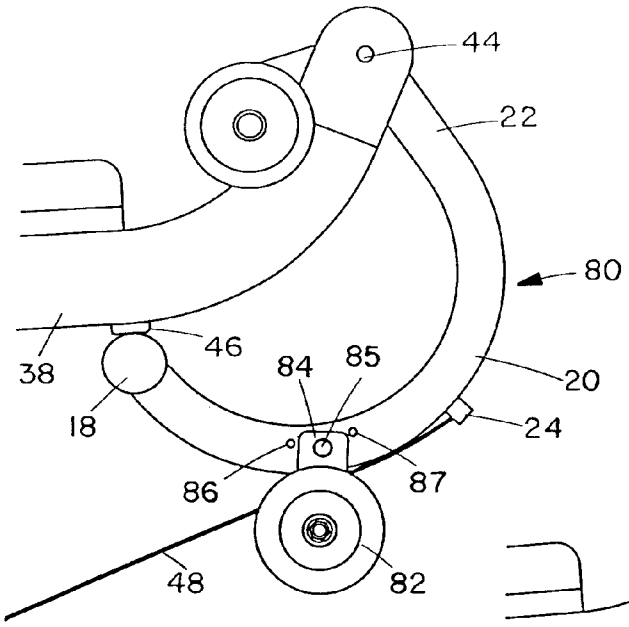
FIG. 9 is a side elevational view similar to FIG. 8 illustrating another modified leg exercise arm.

FIG. 9 illustrates another modified leg exercise arm 80 in which the fixed leg engaging rollers 26 of FIGS. 1 to 6 are replaced with swiveling leg engaging rollers 82. The swiveling rollers 82 are similar to those described in my U.S. Pat. No. 5,961,428 referred to above, the contents of which are incorporated herein by reference. Each roller 82 is secured to a swivel bracket 84 which rotates about pivot pin 85. End stops 86,87 limit the rotation of the swivel bracket to control the roller end positions. The exercise arm 80 is otherwise identical to that of FIGS. 1 to 6, and like reference numerals have been used for like parts as appropriate.

Figure 10:
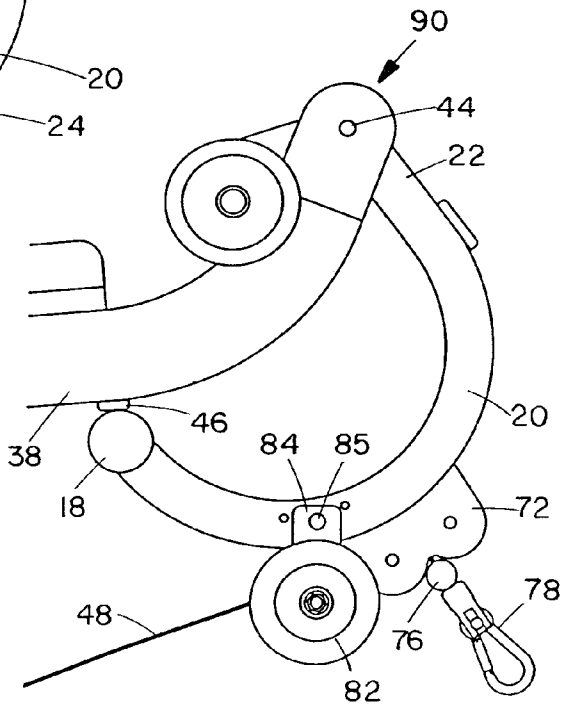
FIG. 10 is a side elevational view similar to FIGS. 8 and 9 illustrating another modified leg exercise arm.

FIG. 10 illustrates another modified leg exercise arm 90 which combines the swiveling leg engaging rollers 82 of FIG. 9 with the cable guide pulley arrangement of FIG. 8, and like reference numerals have been used for like parts as appropriate. This arrangement permits additional exercises to be performed by attaching devices to the end of the cable, and also permits the position of the leg engaging roller pads to be adjusted.

The leg exercise arm apparatus of this invention has several advantages over prior art designs. The 180 degree continuous curve design acts like a cam and provides a surface for the cable to wrap around during the exercise movement, avoiding the need for welding of secondary cams to the exercise arm and preventing resistance drop-off. The upper, forwardly projecting portion of the arm provides a convenient gripping area for a user to lift the front end of the machine in order to move it around as needed. The gripping area is close to the pivot point, so that the arm can normally be used to lift the machine without pivoting about the pivot. The position of the gripping area is high enough such that the user does not have to kneel down in order to safely grip and lift the machine. Another advantage is the positioning of the leg engaging rollers. Because the entire arm acts as a cam, due to the continuous curve design extending along at least the majority of its length, the leg engaging rollers can be positioned at the lowest point on the arm, which is also the cable contact point. This means that the resistance on the arm is a true 100% of the selected exercise resistance, unlike prior art arrangements.

Although some exemplary embodiments of the invention have been described above by way of example only, it will be understood by those skilled in the field that modifications may be made to the disclosed embodiment without departing from the scope of the invention, which is defined by the appended claims.

I claim:

1. An apparatus for performing exercises, comprising:

a support frame;

a seat mounted on the support frame and having a forward end;

a unitary, one-piece exercise arm having a first end pivoted to the support frame adjacent the forward end of the seat, and a second end, the arm having a continuous curve extending along at least a major portion of its length and bending through an arc of at least 180 degrees, the arm having a rest position in which the continuous curve of the arm first projects forwards from the pivot and then curves back rearwards up to the second end of the arm located rearwardly of the pivoted end;

a cable linking the arm to the exercise resistance; and a leg engaging assembly attached to the arm for engagement by the legs of a user in performing exercises.

2. An apparatus for performing exercises, comprising:

a support frame;

a seat mounted on the support frame and having a forward end;

an exercise arm having a first end pivoted to the support frame adjacent the forward end of the seat, and a second end, the arm having a continuous curve extending along at least a major portion of its length and bending through an arc of at least 180 degrees, the arm having a rest position in which the arm first projects forwards from the pivot and then bends back rearwards;

a cable linking the arm to an exercise resistance; and a leg engaging assembly attached to the arm for engagement by the legs of a user in performing exercises;

the frame having a seat support portion and the seat is mounted on the seat support portion; and the second end of the arm resting against the seat support frame when the arm is in the rest position and comprising a stop for preventing rearward movement of the arm when in the rest position.

3. The apparatus as claimed in claim 1, wherein the second end of the arm is of a curved shape having no sharp edges for providing a smooth, curved surface for the cable to wrap around.

4. The apparatus as claimed in claim 3, wherein a tubular member is rigidly secured to the second end of the arm in an orientation transverse to the arm axis, the tubular member comprising said curved surface.

5. The apparatus as claimed in claim 1, wherein the arm has an upper portion which projects forwards from the pivot in said rest position, the upper portion comprising a hand grip for lifting a forward end of the machine.

6. The apparatus as claimed in claim 5, wherein the frame has front and rear foot portions for engaging the ground to support the apparatus in an upright condition, the rear portion having at least one wheel for engaging the ground to allow the apparatus to be moved when the front foot portion is lifted upwards using the upper portion of the leg exercise arm as a handle.

7. The apparatus as claimed in claim 5, wherein the upper end portion of the arm is approximately 22 inches above the ground in the rest position.

8. The apparatus as claimed in claim 5, wherein the upper end portion projects forwards from the pivot by a distance of approximately three inches, and the arm then curves rearwardly beneath the seat supporting portion of the frame.

9. An apparatus for performing exercises, comprising:

a support frame;

a seat mounted on the support frame and having a forward end;

an exercise arm having a first end pivoted to the support frame adjacent the forward end of the seat, and a second end, the arm having a continuous curve extending along at least a major portion of its length and bending through an arc of at least 180 degrees, the arm having a rest position in which the arm first projects forwards from the pivot and then bends back rearwards;

a cable linking the arm to an exercise resistance;

a leg engaging assembly attached to the arm for engagement by the legs of a user in performing exercises;

the arm having an upper portion which projects forwards from the pivot in said rest position, the upper portion comprising a hand grip for lifting a forward end of the machine; and a locking device for releasably securing the arm in the rest position during use of the arm as a handle for lifting the forward end of the machine.

10. The apparatus as claimed in claim 1, wherein the leg engaging device is mounted on the curved portion of the arm.

11. The apparatus as claimed in claim 10, wherein the leg engaging device is positioned on the lowest portion of the arm when in the rest position.

12. The apparatus as claimed in claim 1, including a cable attachment device on the arm for attaching the cable to the arm, the leg engaging device being positioned adjacent and below the cable attachment device.

13. The apparatus as claimed in claim 12, wherein the cable attachment device comprises a cable anchor, and the cable has an end secured to the anchor.

14. An apparatus for performing exercises, comprising:

a support frame;

a seat mounted on the support frame and having a forward end;

an exercise arm having a first end pivoted to the support frame adjacent the forward end of the seat, and a second end, the arm having a continuous curve extending along at least a major portion of its length and bending through an arc of at least 180 degrees, the arm having a rest position in which the arm first projects forwards from the pivot and then bends back rearwards;

a cable linking the arm to an exercise resistance; and a leg engaging assembly attached to the arm for engagement by the legs of a user in performing exercises;

a cable attachment device on the arm for attaching the cable to the arm, the leg engaging device being positioned adjacent and below the cable attachment device; and the cable attachment device comprising at least one pulley, and the cable extends around the pulley, the cable having a forward end in front of the pulley, and a stop on the forward end of the cable for preventing retraction of the cable end off the pulley.

15. The apparatus as claimed in claim 14, wherein the cable attachment device comprises a pair of pulleys, and the cable extends between the pulleys to the front of the arm.

16. The apparatus as claimed in claim 1, wherein the leg engaging device comprises a pair of oppositely directed leg engaging roller pads extending in opposite directions from the arm.

17. The apparatus as claimed in claim 16, including a hinge member pivotally secured to a curved portion of the arm for rotation about a pivot axis transverse to the arm, the roller pads being secured to the hinge member for adjustment of the roller pad position relative to the arm.

18. An apparatus for performing exercises, comprising:

a support frame;

a seat mounted on the support frame and having a forward end;

an exercise arm having a first end pivoted to the support frame at a pivot adjacent the forward end of the seat, and a second end, the arm having a rest position, and having a continuous curve extending along more than half of its length and bending through an arc of at least 180 degrees, the continuous curve in the rest position of the arm starting at a location closer to the first end of the arm and curving from that location in a direction forwardly from the pivot, and then curving rearwardly up to the second end of the arm, the second end of the arm in the rest position being located rearward of the pivot;

a cable linking the arm to the exercise resistance; and a leg engaging assembly attached to the arm for engagement by the legs of a user in performing exercises.

* * * * *